United States Patent [19]

Peltie

[11] 4,210,084

[45] Jul. 1, 1980

[54] ANTI-COLLISION DEVICE FOR PASSIVE VEHICLES

[75] Inventor: Patrick Peltie, Grenoble, France

[73] Assignee: Poma 2000 S.A., Grenoble, France

[21] Appl. No.: 925,823

[22] Filed: Jul. 18, 1978

[30] Foreign Application Priority Data

Aug. 4, 1977 [FR] France ..... 77 24153

[51] Int. Cl.[2] ..... B61B 7/00

[52] U.S. Cl. ..... 104/178; 104/295; 246/187 C

[58] Field of Search ..... 104/173 R, 178, 183, 104/149, 152; 246/187 C, 182 B

[56] References Cited

U.S. PATENT DOCUMENTS 3,871,303 3/1975 Woodling ..... 104/173 R
4,066,230 1/1978 Nohmi et al. ..... 246/182 B
4,092,929 6/1978 Laurent ..... 104/173 R

FOREIGN PATENT DOCUMENTS 1506376 4/1978 United Kingdom ..... 246/187 C

*Primary Examiner*—John P. Silverstrim
*Assistant Examiner*—Ross Weaver
*Attorney, Agent, or Firm*—Stevens, Davis, Miller & Mosher

[57] ABSTRACT

The invention relates to an anti-collision device for passive vehicles. The anti-collision device is governed by the means for driving the vehicles associated with the track to monitor continuously that the distance separating two successive vehicles is greater than the emergency braking distance of the following vehicle. The device is applicable to a transport installation with a line track.

Refer to FIG. 1.

6 Claims, 7 Drawing Figures

ANTI-COLLISION DEVICE FOR PASSIVE VEHICLES

The invention relates to an anti-collision device for a transport installation with passive vehicles running on a track equipped with means for the propulsion of vehicles from the track, the latter being subdivided into sections, each of which is equipped with an individual means of propulsion controlling the travel of a vehicle engaged on the section, an upper section being followed by a lower section, the terms upper and lower being defined in relation to the direction of travel of the vehicles.

The known anti-collision devices of the kind mentioned are based on a discreet knowledge of the position of the vehicles imparted by components spaced out along the track detecting the passing of the vehicles. The track is thus divided into lengths and the occupation or non-occupation of the lengths resulting from the division is determined by rules. This solution presents a great disadvantage in that a reduction of the time interval between successive vehicles necessitates an increase in the number of the components detecting the passing of the vehicles. This leads in particular to a very high density of these components in the most critical zones where a vehicle is stopped or runs a reduced speed on the track whereas the following vehicle is running at high speeds and starts to slow down, in particular at the entrance to a station.

The object of the present invention is to overcome this disadvantage and to enable the realization of an anti-collision device permitting a reduction of the time interval between vehicles to the minimum allowable in consideration of the characteristics of the emergency braking, and making it possible to dispense with component detecting their passing through sections.

The anti-collision device according to the invention is distinguished by the fact that an upper section of the track is equipped with means for the measuring and the elaboration of continuous signals representing the position and the speed of the vehicle engaged on the section and that the lower section adjacent to the said upper section is equipped with means for measuring and the elaboration of a continuous signal indicating the position of a vehicle engaged on the lower section, the said signals being transmitted to a processing and signalling unit provided with a means to indicate the capacity for emergency deceleration of the upper vehicle, the said unit emitting an alarm signal in case of risk of catching-up and collision between the upper and lower vehicles.

The present invention is based on the observation that in the case of an installation with an active track and passive vehicles it is possible to have available on the ground continuous information on the position of the different vehicles without any necessity for the transmission of signals between the vehicles and the ground or from one vehicle to another. The installation may be of the type in which the vehicles are hauled on cruising sections by cables and in the stations by wheels, but it may be only wheels or only haulage cables or analagous devices, the differences in speed between vehicles being possible due to the use of several cables or wheels without any mechanical link between them. The connection between the vehicle and the drive system, in particular with cables or wheels must of course be made permanently and positively.

The anti-collision device according to the invention relates most particularly, but not exclusively, to the protection of vehicles waiting at the platform of a station, by monitoring the approach of the following vehicle, in such manner that the latter can always be braked and any telescoping avoided. This monitoring is effected by associating ficticiously with each lower vehicle for instance at a platform a limit overspeed curve defining for each upper vehicle the maximum permitted speed for the latter, which speed still permits emergency braking without collision. The limit overspeed curve, which protects the lower vehicle against any collision, accompanies this vehicle when it is started to permit a minimum interval between vehicles and thus a maximum transport capacity. It is an advantage, when defining the overspeed curve, not to take into account the minimum braking travel of the lower vehicle, as a sudden stop can take place at full speed, for some external reason, in particular a derailment.

By designating the position of the lower and upper vehicles as $x_1$ and $x_2$ and their length as L, it will be understood that the distance separating the two vehicles $x_1-L-x_2$ must be greater than the emergency braking travel, which is equal to $$\frac{1}{2\Gamma}\lambda^2 V_2^2 + \left(1+\frac{\gamma_1}{\Gamma}\right)\theta\lambda V_2 + \gamma_1\frac{\theta^2}{2}\left(\frac{\gamma_1}{\Gamma}+1\right)$$

$\Gamma$ being the emergency deceleration
$\theta$ the brake response time
$V_2$ the nominal speed of the upper vehicle
$\lambda$ a coefficient of authorized overspeed
$\gamma_1$ acceleration of the upper vehicle.

The condition for tripping the anti-collision device is therefore $$\frac{1}{2\Gamma}\lambda^2 V_2^2 + \left(1+\frac{\gamma_1}{\Gamma}\right)\theta\lambda V_2 + \gamma_1\frac{\theta^2}{2}\left(\frac{\gamma_1}{\Gamma}+1\right) + x_2 - x_1 + L \geqq o.$$

The terms $\Gamma$, $\lambda$, $\theta$, $\gamma$ and L are the variables to be measured to be put into form and introduced into the calculation circuits. The variables $x_2$, $V_2$ and $V_2^2$ are elaborated from data collected from the upper means of propulsion, for example the deceleration cable, and the variable $x_1$ is incremented on the basis of data collected from the lower means of propulsion, for example the acceleration cable.

The electronic circuits for the elaboration of the elementary variables, the calculation circuits and the final comparison circuit are for preference doubled and the results are validated by safety comparators to eliminate practically any risk of error.

Other advantages and features will be evident from the following account of a mode of application of the invention, given as a non-limitative example and shown in the attached drawings in which.

Figure 1:
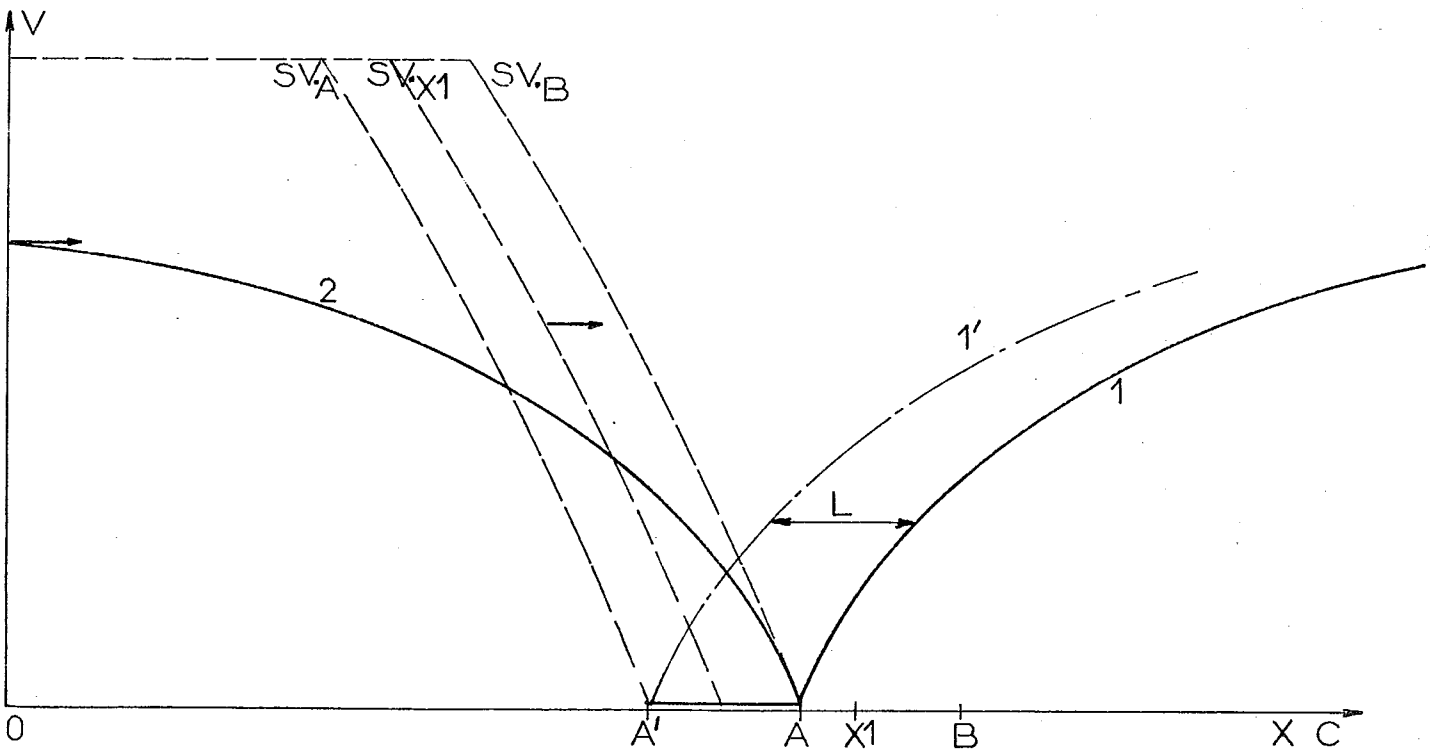
FIG. 1 is a diagram of speed and position of a Station on which the deceleration and acceleration curves are represented by continuous lines and the protection curves by dotted lines.

In FIG. 1, the successive positions of the vehicles in a station are shown as abscisses on the centreline of x, point O corresponding to the start of the deceleration of a vehicle, point A to the stopping and point C to the end of the acceleration of a vehicle. The speeds are shown as ordinates, and curve 2 illustrates the normal deceleration of a vehicle engaged on the deceleration section, while curve 1 illustrates the acceleration of a vehicle engaged on the acceleration section. The two curves 1, 2 meet at the stopping point A, which represents, for example, the position of the front of a halted vehicle. A composite line 1' shows the acceleration curve of the rear of the lower vehicle, which is deduced from curve 1 by a translation of a distance L, corresponding to the length of the vehicles. It is easily seen that the upper vehicle risks striking the lower vehicle in the zone of intersection of curves 2 and 1', this risk being eliminated as soon as the lower vehicle has passed point B, of abscissa A+L, the rear of the vehicle having by then passed the stopping point A. This risk is also inexistent as long as the upper vehicle is at a distance from point A', corresponding to the rear of a stopped vehicle, sufficient for emergency braking. By designating by V the speed of the vehicles at the entrance to the deceleration section and at the exit from the acceleration section, and by λ an overspeed coefficient, the maximum speed of the vehicle is λV, and the limit overspeed curve $SV_A$ represents the emergency deceleration of a vehicle running at maximum speed λV to stop it at point A'. A halted vehicle at point A is thus protected against any collision as long as the following vehicle, engaged on the deceleration section, remains within the limits defined by the overspeed curve $SV_A$. When the protected vehicle starts and reaches for instance abcissa $x_1$ the limit overspeed curve accompanies the latter in its travel and is represented at $SVx_1$ in FIG. 1. The limit overspeed curve $SV_B$ corresponds to abscissa B.

The anti-collision device permanently checks that the following vehicle is maintained within the protection curves.

Figure 7:
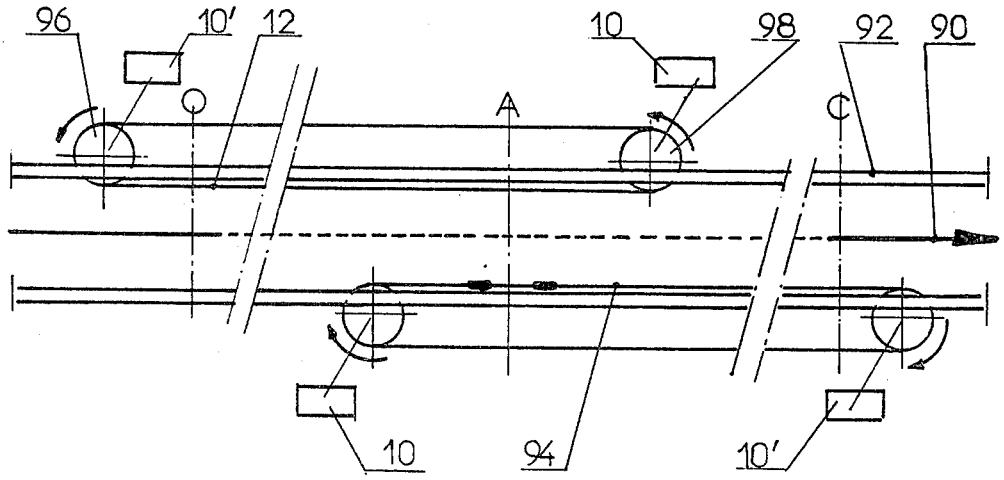
FIG. 7 is a diagrammatic view in plan of a station of the installation.

On referring more particularly to FIG. 7, it may be seen that the installation comprises a main cable running continuously at cruising speed V, on to which are coupled the vehicles on the cruising sections of a track 92. At the entrance to a station the vehicle is uncoupled from the main cable 90 and coupled to a deceleration cable 12, so as to stop at point A, where a new change of cable is effected to couple the vehicle on to an acceleration cable 94, bringing the vehicle to speed V at the exit from the station. All precautions are taken to prevent the coupling grips from slipping on the cables 12, 94, and a reversing of the vehicles. Such an installation is described in U.S. patent application Ser. No. 750,143 of Dec. 13, 1976, to which reference will be made for more ample details. The deceleration cable 12 runs over idler sheaves 96, 98 one of which at least is driven. The shaft of sheave 96 drives a sensor 10 and that of sheave 98 a sensor 10', which measure the travel of cable 12.

The anti-collision safety is tripped in the manner described above when the following condition is fulfilled:

$$\frac{1}{2\Gamma}\lambda^2 V_2^2 + \left(1 + \frac{\gamma_1}{\Gamma}\right)\theta\lambda V_2 + \gamma_1 \frac{\theta^2}{2}\left(\frac{\gamma_1}{\Gamma} + 1\right) + x_2 - x_1 + L \geqq o.$$

The speed $V_1$ of the lower vehicle does not intervene in the formula because it is accepted that this vehicle can come to a sudden stop. This supposition normally adds a safety margin.

The variables $x_2$, $V_2$ and $V_2^2$ correspond to the vehicle engaged on the deceleration section and are derived from the means of propulsion of the vehicle, in particular from the deceleration cable 12. The variable $x_1$ belongs to the lower vehicle on the acceleration cable and it is established from the movement of the accelerator cable 94.

Figure 2:
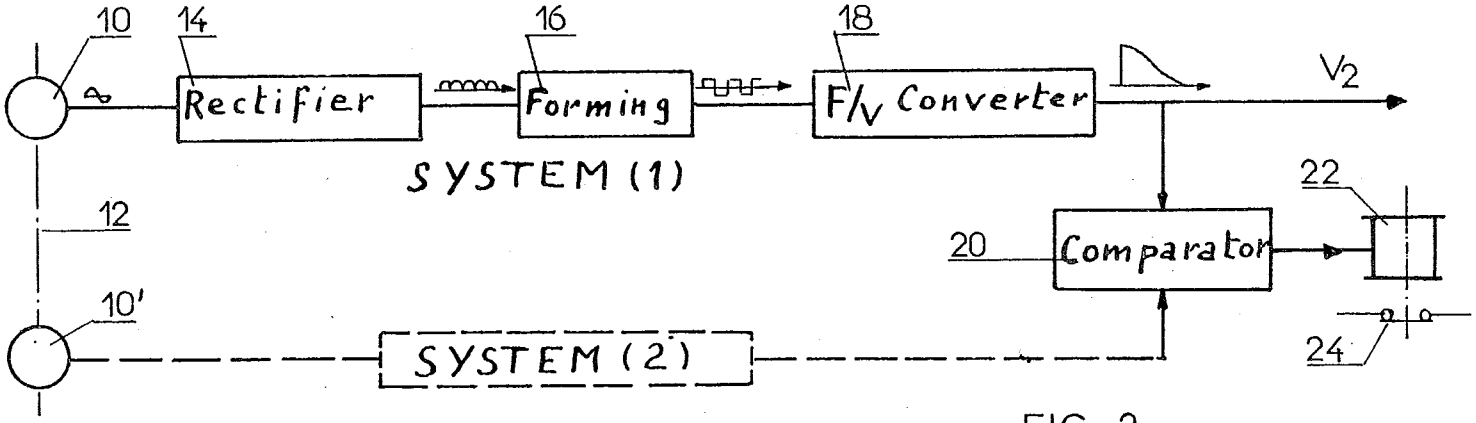
FIG. 2 is a block diagram of the speed data elaboration circuits.

The diagram showing the elaboration of speed $V_2$ is shown in FIG. 2. The travel sensor 10 measures the travel of cable 12 which corresponds with that of the vehicle coupled to the cable. The sensor 10 is the pulse type feeding a processing system (1) including a two alternation rectifier circuit 14, a forming circuit 16 reinstating square signals applied to a frequency/voltage converter 18 emitting an analogous signal representing the speed $V_2$. The system (1) is not intrinsically safe, and to limit risks of error, the whole is duplicated, the second pulse travel sensor 10' measuring the travel of cable 12 and feeding a second system (2) identical with system (1), the data delivered by the two systems (1) and (2) being applied and compared in a safety comparator 20. Comparator 20 actions a relay 22 the contacts 24 of which are inserted in a general monitoring circuit (not shown). The comparator 20 checks the identy of the outputs of systems (1) and (2) and in case of discordance commands the opening of contacts 24 signalling a fault. The use of two identical and independent systems for the elaboration of the same data makes it very improbable that there should appear at the same moment a breakdown on the two systems still producing identical outputs.

If the level of this probability is still too high, it is possible to increase the number of identical systems in parallel while checking them two by two by means of safety comparators. The sensors 10, 10' are mounted on independent shafts, so as to signal a fault due to the breakage of one of these shafts. The probability of the simultaneous breaking of the two shafts is low.

Figure 3:
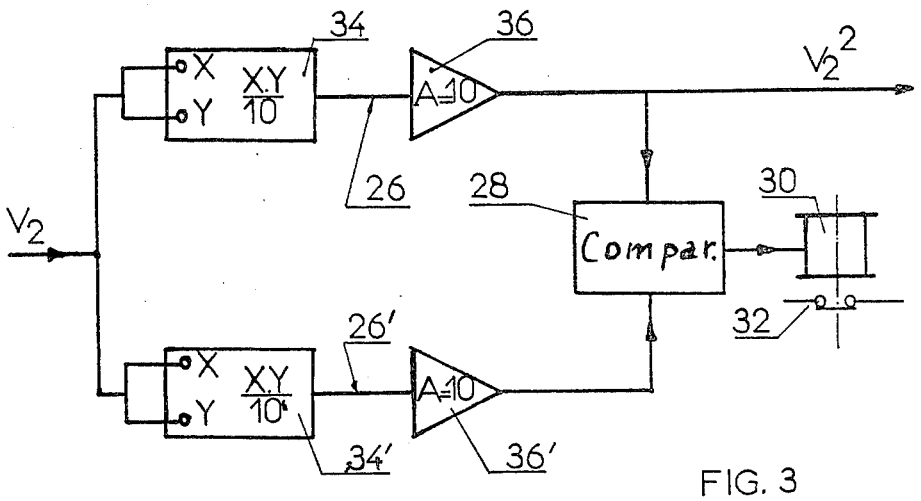
FIG. 3 is a block diagram of the speed data squared elaboration circuits.

The diagram of the elaboration of the squared data on speed $V_2$ is shown in FIG. 3. Its general organization of the same type as that of the preceding function: two identical "non-security" systems 26, 26' are monitored by a safety comparator 28, commanding a check relay 30 the contacts 32 of which are held closed as long as the signals delivered by systems 26, 26' are identical. The contacts 32 are inserted in the monitoring circuit. Each of the systems 26, 26' comprises two elements, an analogous electronic multiplier 34, 34' carrying out the function XY/10 and an operational amplifier 36, 36' with a gain of 10. An overall precision of the order of 1% is currently obtainable with this type of circuit, which is largely sufficient for this application. It is data $V_2$, output from the circuit previously validated by safety comparator 20, which serves as input for this circuit and is applied to inputs XY of the multipliers 34, 34'.

Figure 4:
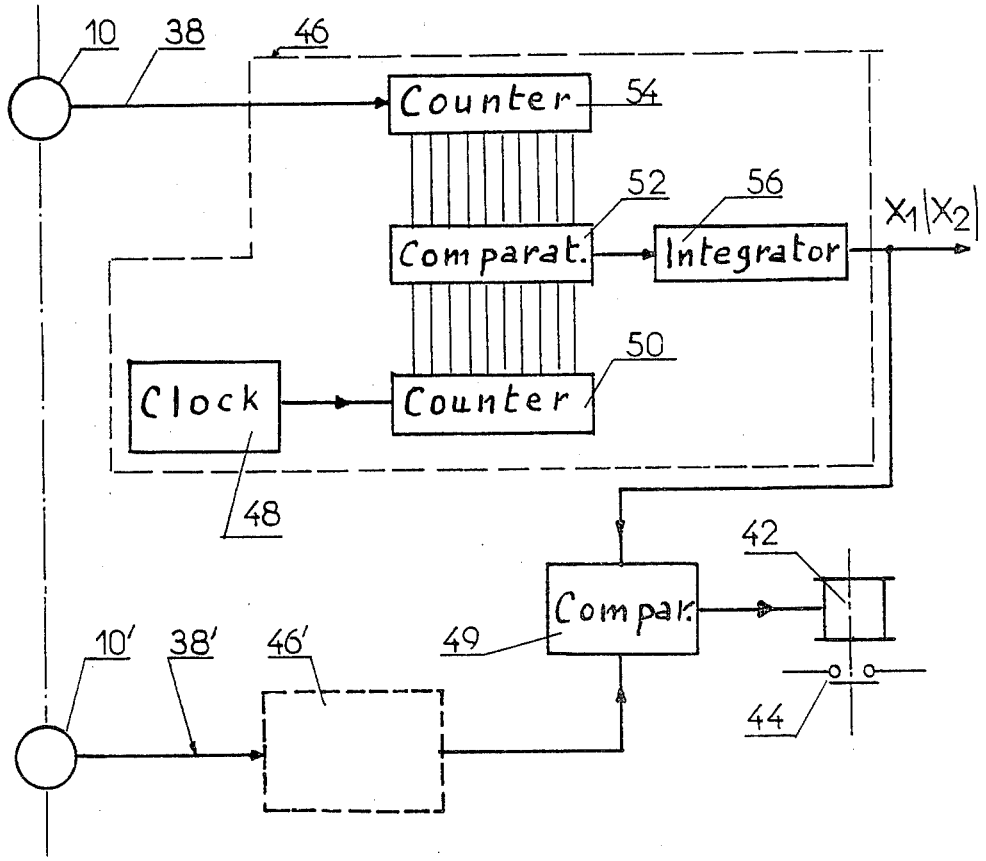
FIG. 4 is a block diagram of the position data elaboration circuits.

The principle diagram of the elaboration of the position data $x_1$ or $x_2$ is shown in FIG. 4. The circuit consists of two identical "non security" systems 38, 38' compared one with the other by a safety comparator 40, which performs the same functions as in the previous cases and actions a relay 42 with contacts 44 inserted in the monitoring circuit. Each system 38, 38' has an input a pulse travel sensor, which can be sensor 10, 10' in FIG. 2 for data $x_2$.

The output of each sensor 10, 10' is connected with a stochastic converter 46, 46', the output of which supplies the position data. The circuit associated with the accelerator cable 12 supplies data $x_1$ and that associated with the decelerator cable 94 data $x_2$. The converter 46, 46' has a clock 48 actioning an annexed counter 50, the output of which is compared in a comparator 52 on the output of a main counter 54 of the pulses delivered by sensor 10, 10'. The output signal of comparator 52 is integrated in an integrator 56 furnishing the analogous signal of position $x_1$ or $x_2$. This circuit is a conventional digital-analog converter.

Figure 5:
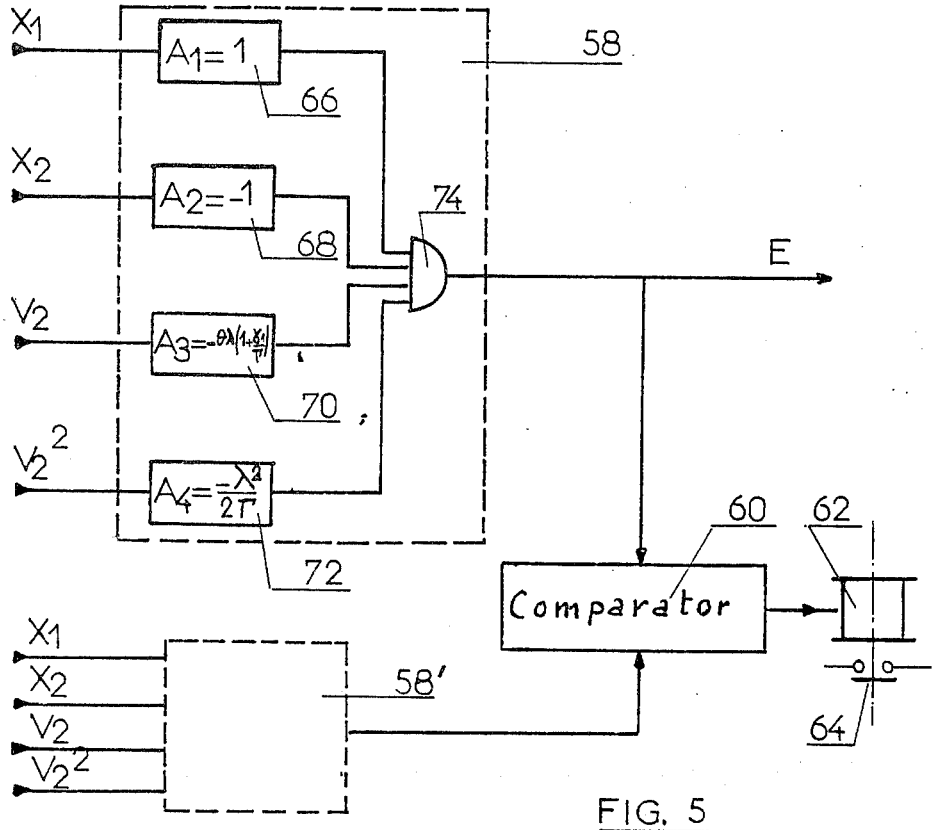
FIG. 5 is the diagram of the principle of the calculation circuit.

The basic signals elaborated and available at the outputs of the above mentioned circuits, in the occurrence $x_1$, $x_2$, $V_2$ and $V_2^2$ are applied to a computing circuit, shown in FIG. 5, elaborating the expression $$x_1 - x_2 - (1 + \frac{\gamma_1}{\Gamma})\,\theta\lambda V_2 - \frac{1}{2\Gamma}\lambda^2 V_2^2.$$

The circuit again has two identical systems 58, 58', the outputs of which are compared in a comparator 60 actioning a relay 62 with contacts 64 inserted in the monitoring circuit. Each of the systems 58, 58' includes adjustable gain amplifiers; the amplifier 66 receiving data $x_1$ having an amplification factor of 1, amplifier 68 of data $x_2$ a factor of $-1$, the amplifier 70 of data $V_2$ a factor of $$-(1 + \frac{\gamma_1}{\Gamma})\,\lambda\theta,$$

and the amplifier 72 of data $V_2^2$ a factor of $-\lambda 2/2\Gamma$.

Figure 6:
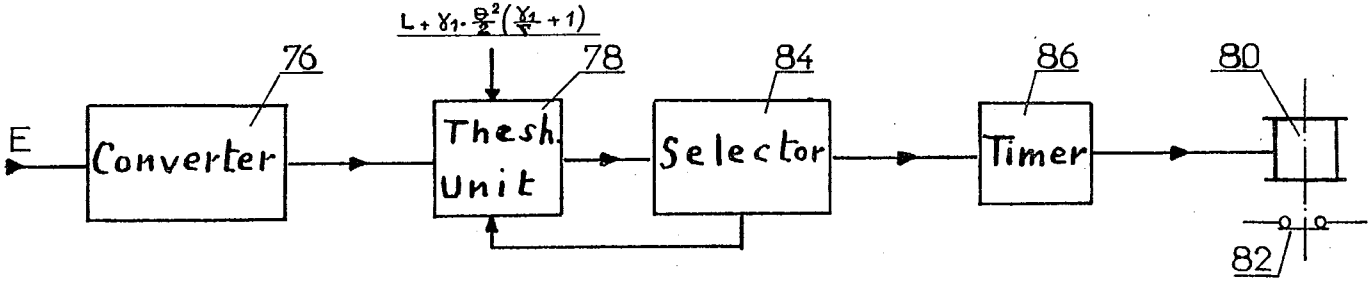
FIG. 6 is the diagram of the final comparison circuit.

The outputs of amplifiers 66 to 72 are connected to a summation circuit 74 the output E of which furnishes a signal corresponding to the above mentioned expression, which is applied to a final comparison circuit shown diagramatically in FIG. 6. The analogous signal E is transformed by a converter 76 into a series of calibrated pulses the period of which represents the value of signal E. These pulses are compared in a unit 78 with a fixed time base the period of which is determined by the value of $$L + \gamma_1 \frac{\theta^2}{2}\left(\frac{\gamma_1}{\Gamma} + 1\right),$$

and which constitutes a threshold period. As long as the period of the pulses E is greater than this fixed base threshold, unit 78 actions a relay 80 so as to maintain contacts 82 of relay 80 in the high position. The period threshold of unit 78 is monitored by a safety period selector 84 working in conjunction with a safety drop timer. The final comparison circuit is best designed so that any fault results in the fall of relay 80, and thus to an emergency breaking and to a non-dangerous situation. The circuit can of course be doubled in the manner described above.

It is unnecessary to describe the components of the various circuits, which are well known in themselves, and the operation of the anti-collision device, which is evident from the above account.

By way of example the commercial references, names and manufacturers of components suitable for above mentioned circuits are now given:

| Component | Name | Manufacturer |
|---|---|---|
| frequency/voltage converter 18 and voltage/frequency converter 76 | voltage to frequency and frequency to voltage converter VFC 32 | Burr-Brown |
| multiplier 34 | integrated circuit multiplier AD 532 | Analog Devices |
| amplifier 36 | operational amplifier AD 741 K | Analog Devices |
| clock 48, annexed counter 50, comparator 52 | 10 bit D/A converter AY-6-5053 | General Instrument, Europe |
| main counter 54 | binary counter MC-14020 B | Motorola |
| integrator 56 | operational amplifier AD 741 K | Analog Devices |
| amplifier 66, 68, 70, 72 | operational amplifier AD 741 K | Analog Devices |

It should be noted that the device according to the invention carries out a permanent monitoring and intervenes on the appearance of a critical situation to trip the emergency braking of the upper vehicle by any operating means, in particular by brakes on or off the vehicle. The anti-collision device can be inserted in a conventional safety system comprising imbricated fixed sections, and take into account additional factors. The invention is applicable to installations with overlapping sections, or sections not meeting at a stopping point.

What is claimed is:

1. An anti-collision device for a transport installation with passive vehicles running on a track equipped with a means of propulsion of the vehicles from the track, the latter being subdivided into sections, an upper section and a lower section, each equipped with an individual means of propulsion controlling the travel of a vehicle engaged on the section, an upper section being followed by a lower section, the terms upper and lower being defined in relation to the direction of circulation of the vehilces, comprising means equipping an upper section of the track for measuring and for the elaboration of continuous signals representing the position $X_2$ and speed $V_2$ of the vehicle engaged on the section and means equipping the lower section adjacent to the said upper section for measuring and for the elaboration of a continuous signal of the position $X_1$ of the vehicle engaged on the lower section, and a processing and signalling unit receiving the said signals $X_2$ $V_2$ $X_1$ having means to indicate parameters of the installation influencing the catching up of the vehicles comprising means to indicate the length L of a vehicle and means to indicate the deceleration $\Gamma$ capacity of a vehicle, the said processing and signalling constituting means to signal a risk of collision when the spacing between the vehicles $X_1 - X_2 - L$ is equal to or smaller than the emergency braking capacity of the upper vehicle at a velocity $V_2$.

2. An anti-collision device in accordance with claim 1, the said means of measuring and of elaboration of the signals and the said processing and signalling unit being designed to signal a risk of collision as soon as the non-equation is no longer respected:

$$\frac{1}{2\Gamma}\lambda^2 V_2^2 + (1 + \frac{\gamma_1}{\Gamma})\theta\lambda V_2 + \gamma_1 \frac{\theta^2}{2}(\frac{\gamma_1}{\Gamma} + 1) + x_2 - x_1 + L \geqq o,$$

in which $V_2$ and $x_2$ designate respectively the speed and position of the upper vehicle, $x_1$ the position of the lower vehicle, L the length of a vehicle, $\gamma_1$, $\lambda$, $\theta$ and $\Gamma$ parameters corresponding respectively to an acceleration of the upper vehicle, a maximum overspeed coefficient, the brake response time and the deceleration capacity of a vehicle.

3. An anti-collision device in accordance with claim 2, having a pulse travel sensor linked to the means of propulsion to emit a digital data of the length of travel, and a system receiving the later data and elaborating an analogous vehicle speed data.

4. An anti-collision device in accordance with claim 3, having a travel sensor, linked to the means of propulsion of a section and emitting pulses and a system receiving the later pulses and including a counter and a clock for elaborating an analogous signal, representing the travel of the vehicle.

5. An anti-collision device in accordance with claim 4, further comprising adjustable gain amplifiers on which are applied the representative data of the positions of the upper and lower vehicles and of the speed of the upper vehicle and a summation circuit wherein the output signals of said amplifiers are summed.

6. An anti-collision device in accordance with claim 5, wherein the said sensors, systems and/or processing unit circuits are doubled and comprising safety comparators checking the identity of conjugated signals to emit a fault signal in case of discordance.

* * * * *